United States Patent [19]

Kammel et al.

[11] 4,312,724

[45] Jan. 26, 1982

[54] METHOD FOR THE RECOVERY OF LEAD FROM MATERIALS CONTAINING LEAD SULFIDE

[76] Inventors: Roland Kammel, Mommsenstrasse 24, D-1000 Berlin 12; Hans-Wilhelm Lieber, Ilsensteinweg 3g, D-1000 Berlin 38, both of Fed. Rep. of Germany

[21] Appl. No.: 45,731

[22] Filed: Jun. 5, 1979

Related U.S. Application Data

[63] Continuation of Ser. No. 44,264, May 31, 1979, abandoned.

[30] Foreign Application Priority Data

May 31, 1978 [DE] Fed. Rep. of Germany ..... 2823714

[51] Int. Cl.[3] ..... C25C 1/18

[52] U.S. Cl. ..... 204/117

[58] Field of Search ..... 204/117

[56] References Cited

U.S. PATENT DOCUMENTS

| | | | |
|---|---|---|---|
| 1,539,713 | 5/1925 | Christensen | 204/117 |
| 1,587,438 | 6/1926 | Tainton | 204/117 |
| 1,769,605 | 7/1930 | Pike | 204/113 |
| 3,787,293 | 1/1974 | Kametani | 204/117 |

*Primary Examiner*—R. L. Andrews

*Attorney, Agent, or Firm*—Spencer & Kaye

[57] ABSTRACT

Method for the recovery of lead from lead sulfide containing materials such as ores and concentrates wherein the materials are initially leached in a leaching vessel containing a chloride solution and iron (III) chloride as an oxidation agent to form an iron (II) chloride solution containing lead chloride. The latter solution is then conducted to an electrolytic cell comprising at least one insoluble anode and at least one cathode for the cathodic deposition of lead. The electrolyte containing iron (III) ions formed by the oxidation of iron (II) ions at the anode is returned to the leaching vessel for the further leaching of lead sulfide containing materials.

14 Claims, 3 Drawing Figures

METHOD FOR THE RECOVERY OF LEAD FROM MATERIALS CONTAINING LEAD SULFIDE

This application is a continuation of application Ser. No. 044,264, filed May 31, 1979, now abandoned.

BACKGROUND OF THE INVENTION

The present invention relates generally to a method for the recovery of lead and more particularly to a method for recovering lead from a material or ore containing lead sulfide wherein the lead sulfide containing material or ore is initially leached in a leaching vessel. The lead sulfide containing material or ore is leached in a chloride solution to which iron (III) chloride has been added as an oxidation agent, and thereafter subjected to an electrolytic treatment.

In order to obtain lead from sulfide containing materials or ores, pyrometallurgical and hydrometallurgical methods have essentially been used in the art. According to the roast-reduction method or the roast-reaction method, for example, sulfur in the form of a sulfide (lead sulfide) may be readily treated by roasting to form sulfur dioxide which is processed into sulfuric acid. After multistage refining of the resulting raw lead, fine lead is finally obtained. The treating and refining of lead sulfide ores by such methods, which ores contain in addition to lead and sulfur, inter alia, copper, zinc, antimony, arsenic, iron, cadmium as well as noble metals, produces substantial environmental pollution because the various processing steps result in the discharge of sulfur dioxide and other gaseous pollutants as well as toxic fine dusts.

In view of the environmental problems associated with pyrometallurgical processes, hydrometallurgical methods are being considered with increasing frequency. According to one such known method, for example, anodes are made to lead sulfide ones, and subjected to electrolysis. However, the poor stability of these anodes and sulfur coatings developing thereon, restrict this mode of operation to within narrow limits. Instead of the method employing preshaped anodes, methods also exist wherein lead sulfide concentrates, in suspension, are anodically dissolved. According to these suspension electrolysis methods, lead sulfide particles are intensively moved within the anode chamber of an electrolytic cell so that the particles come into frequent contact with the chemically inert anode and in a way, dissolve quasi-anodically. The basic electrolyte used is silicofluoric acid and borofluoric acid.

A disadvantage of these methods is that the anode and cathode chambers must be separated by membranes or diaphragms which are mechanically sensitive, decompose easily and exhibit a high electrical resistance. Further disadvantages of these methods are that relatively expensive, fluorine containing basic electrolytes are used and that the lead sulfide containing raw materials, including annoying ancillary components and impurities therein, are introduced into the electrolysis cell.

It is known that lead is readily soluble in solutions containing large amounts of chloride, e.g., sodium chloride, because the lead then goes into solution in the form of a chlorocomplex. Thus, a method is known wherein lead sulfide concentrates are leached at about 90° C., in solutions containing about 250 g/l of sodium chloride. The sulfur, in the form of a sulfide is oxidized by copper (II) ions in accordance with the following reaction:

$$PbS + CuCl_2 \rightarrow CuS + PbCl_2.$$

The resulting lead chloride is crystallized out by cooling, and as a fused melt it is reduced by hydrogen to form lead. In a second leaching stage, the copper sulfide containing residue is converted to copper (I) chloride and sulfur according to the following chemical reaction:

$$CuS + CuCl_2 \rightarrow 2CuCl + S^{\circ}.$$

In a third leaching stage, the copper (I) chloride is finally regenerated according to the following chemical reaction:

$$2CuCl + 2HCl + \tfrac{1}{2}O_2 \rightarrow 2CuCl_2 + H_2O,$$

with gaseous hydrochloric acid produced during the reduction of lead chloride and with oxygen from the air. The disadvantage of this method is that the leaching process requires relatively high temperatures in the order of 90°–100° C., and during the reduction of lead chloride hydrochloric acid gases are produced which present a great danger to the environment and particularly to the operating personnel.

According to another known method, lead sulfide is leached at a temperature of about 100° C. in a sodium chloride solution which contains iron (III) chloride that has been added as an oxidation agent. According to the chemical reaction, the lead sulfide is leached with the hot ferric chloride-NaCl solution to obtain lead chloride and elemental sulfur as follows:

$$PbS + 2FeCl_3 \rightarrow PbCl_2 + S^{\circ} + 2FeCl_2$$

In this reaction, the iron (III) chloride is reduced to iron (II) chloride. Lead chloride crystallizes from the leach solution on cooling and thereafter is subjected to fused salt electrolysis, wherein the lead is deposited cathodically and gaseous chlorine develops anodically which serves to reoxidize the iron (II) chloride. This method has the same drawbacks as the preceding method.

In a further known hydrometallurgical method, an electrolysis cell is used which is subdivided into an anode chamber and a cathode chamber by a permselective membrane which permits anions to pass therethrough. In this method, lead sulfide, in a sodium chloride solution containing iron chloride, is subjected to a suspension electrolysis at about 70° C. in the anode chamber, whereby the sulfur in the form of a sulfide (lead sulfide) is oxidized to elemental sulfur and lead chloride is produced with can be crystallized out.

The lead chloride is purified by recrystallization and, after renewed dissolving, is brought into the cathode chamber of the electrolysis cell wherein lead is deposited. Since the cathode chamber and the anode chamber are separated from one another by the membrane which permits anions to pass therethrough, the chloride ions can move over to the anolyte. In this mode of operation, toxic gaseous reaction products are avoided, but the crystallization and redissolving of the lead chloride, for purposes of purification, are rather complicated. The greater problem encountered, however, is that the electrolytic cell is divided into chambers by the permselective membrane. Since this membrane is mechanically sensitive, it clogs easily causing a considerable voltage drop and thus, it presents significant disadvantages when used in the large-scale production of lead.

It all of the prior art methods used for the hydrometallurgical recovery of lead from sulfide containing raw materials, the lead first forms lead chloride which is separated from the liquor by crystallization. The reduction of the lead chloride takes place either in a fused melt, whereby hydrochloric acid or chlorine are released or in an aqueous solution in an electrolytic cell employing a permselective membrane. Thus, the known prior art methods either result in the formation of toxic gases deleterious to the environment or the conditions under which the apparatus are employed prove to be difficult so that these methods can be used only with great restrictions. A need therefore exists for a method to recover lead from lead sulfide containing materials, including ores and concentrates, that avoids the problems previously encountered in prior art processes.

SUMMARY OF THE INVENTION

It is therefore a principal object of the present invention to provide a method wherein it is possible to recover lead from sulfide containing raw materials, e.g., ores and concentrates, without contaminating the environment with toxic gases and which can be practiced with simple and uncomplicated devices.

Another object of the present invention is the use of an electrolytic cell that does not require the use of a diaphragm or permselective membrane.

Additional objects and advantages of the present invention will be set forth in part in the description which follows and in part will be obvious from the description or can be learned by practice of the invention. The objects and advantages are achieved by means of the processes and combinations particularly pointed out in the appended claims.

To achieve the foregoing objects and in accordance with its present purpose, the present invention, as embodied and broadly described, provides a method of the above-mentioned type wherein the iron (II) chloride containing solution, rich in lead chloride from the leaching stage, is conducted from the leaching vessel into an electrolytic cell containing at least one insoluble anode and at least one cathode whereby lead is cathodically deposited. The electrolyte which contains iron (III) ions due to the reoxidation reaction at the anode, is returned to the leaching vessel.

This method can be practiced with apparatus of extremely simple design which essentially comprises the leaching vessel and the electrolysis cell. Conduit means, e.g., pipelines or hoses, may be arranged between the two vessels through which the solution from the leaching vessel, on the one hand, and the electrolyte on the other hand, can be moved from one vessel to the other, preferably by means of pumps.

The operation of this method which can be practiced in a simple manner without complex devices can be explained, in particular, by the fact that the solution rich in lead chloride, can be electrolytically treated without the use of a permselective membrane or a diaphragm. This fact is contrary to prior beliefs of persons of ordinary skill in the art according to whom the electrolysis of lead chloride containing solutions is not economically feasible because of the low lead content and the resulting poor current efficiency. It has also been previously assumed that the iron content of such a solution, from the oxidation of the iron (II) ions at the anode and the subsequent reduction of the anodically formed ion (III) ions at the cathode, would lead to an additional reduction of the current efficiency.

It has now been found in the practice of the method of the present invention that there is no justification for the prior beliefs of those of ordinary skill in the art. In the electrolytic cell, the lead is deposited in metallic form at the cathode and the lead can be removed therefrom in a continuous manner while the iron (II) ions are simultaneously reoxidized to iron (III) ions at the anode. The electrolyte containing iron (III) chloride can thus be returned directly to the leaching vessel, for use as an oxidation agent, so that an equalized balance of substances results, almost automatically, for the cathodic and anodic reactions.

A further advantage of the method of the present invention is that under the conditions of anodic reoxidation of the iron (II) in the chloride solution, the hydrogen sulfide content is relatively low, but sufficient to prevent a significant rise in the electrolyte of concentrations of the metals normally found in the lead ore, such as, for example, copper, zinc, silver, arsenic and antimony.

It is therefore apparent that significant advantages of the method of this invention include the facts that the electrolytic cell requires no diaphragm or permselective membrane, that both the anodic and the cathodic process in the electrolytic cell are utilized equally, and that no gaseous reaction products develop that would present environmental problems. In particular, no polluting gases, sulfur dioxide or toxic fine dusts are produced which would have an adverse effect on the environment.

It is to be understood that both the foregoing general description and the following detailed description of this invention are exemplary, but are not restrictive of the invention.

BRIEF DESCRIPTION OF THE DRAWINGS

The accompanying drawings are illustrative of preferred embodiments of the present invention and, together with the description, serve to explain the principles of the invention.

With reference to FIG. 1, a chloride solution 2 is present in a leaching vessel 1. The chloride solution will preferably be a sodium chloride solution although other chloride solutions, e.g., potassium chloride or calcium chloride, can be used as well. Iron (III) chloride is added to leaching vessel 1 as an oxidation agent to form the leaching solution. Generally, the leaching solution contains about 100 to 300 and preferably between 170 and 250 grams per liter of sodium chloride and about 5 to 100 and preferably between 15 and 25 grams per liter of iron (III) chloride. Lead sulfide containing raw materials, including lead sulfide containing ores and concentrates, e.g., galena, are continuously charged into the leaching vessel 1 as indicated by arrow 3. Generally, from about 20 to 300 grams, and preferably 40 to 60 grams of lead sulfide are present per liter of leaching solution. The lead sulfide containing raw material is subjected to a leaching process in a leaching vessel at a temperature generally between 20° and 80° C., and preferably between 45° and 55° C. for a period of time sufficient for the reaction between the lead sulfide and iron (III) to take place, the time generally being between 3 minutes and 5 hours and preferably between 0.5 and 1.0 hours. This causes the lead to go into solution and the sulfur to be deposited as elemental sulfur in accordance with the following chemical reaction:

$$PbS+2FeCl_3 \rightarrow PbCl_2+2FeCl_2+S^{\circ}.$$

Figure 2:
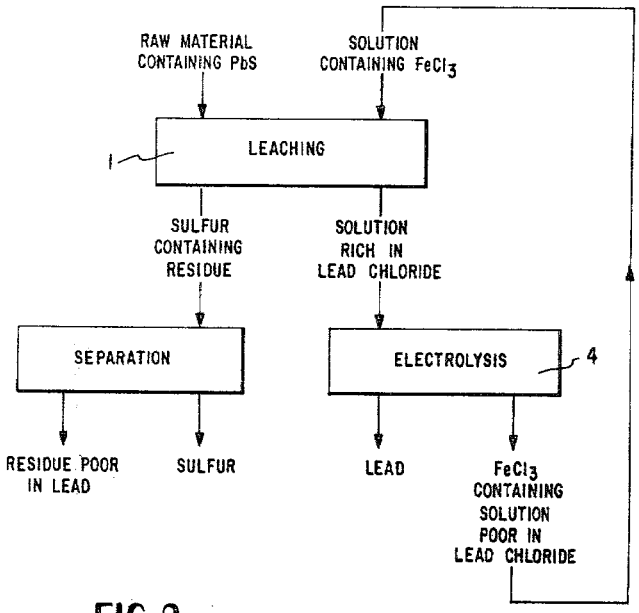
FIGS. 2 and 3 are flow charts of two embodiments, respectively, of the present invention with legends and numerals indicating the various stages or steps in the processes and with the same parts in both embodiments using the same legend and numerals.

The sulfur containing residue is removed, as illustrated in FIG. 2, from the bottom of the leaching vessel 1, and is subjected to, for example, further processing like flotation, extraction of sulfur by organic solvents or separation of a filter press at elevated temperatures above the melting point of sulfur, wherein elemental sulfur is obtained as well as a residue containing the metals originally present in the lead sulfide, e.g., copper, zinc, silver, arsenic and antimony, which are present in enriched amounts.

The solution, rich in lead chloride, obtained during the leaching step is fed into an electrolytic cell 4. Metallic lead is deposited at the cathode 8 according to the electrochemical reaction:

$$Pb^{2+}+2 \text{ electrons} \rightarrow Pb.$$

A reoxidation of iron (II) ions to iron (III) ions takes place at the insoluble anode 7 of the electrolytic cell according to the following electrochemical reaction:

$$2Fe^{2+}-2 \text{ electrons} \rightarrow 2Fe^{3+}.$$

The iron (III) containing solution, which is poor (low) in lead chloride, is returned from electrolytic cell 4 to leaching vessel 1.

Figure 1:
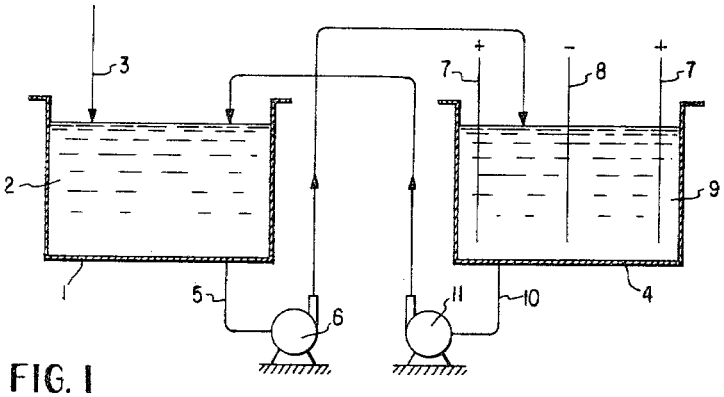
FIG. 1 is a schematic representation of an apparatus for practicing the method in accordance with this invention.

In carrying out the electrolytic treatment, the solution obtained from the leaching step, and which is rich in lead chloride, is conducted, for example, as shown in FIG. 1, from vessel 1 through a conduit means or line 5 by means of a pump 6 into the electrolytic cell wherein at least one insoluble anode 7 and at least one cathode 8 are disposed. In the electrolytic cell that is illustrated, one anode 7 is shown on each side of cathode 8. The electrolyte 9, due to the reoxidation at the anodes, contains iron (III) chloride and can be returned by means of a pump 11 to the leaching vessel 1 through a conduit means or line, where it is once again available as an oxidation agent for the leaching step.

In accordance with an embodiment of the present invention, an equalized balance (stoichiometric amounts) of each reactant in the redox reactions taking place during the leaching stage can be achieved by measuring the redox potential of the solution in leaching vessel 1. The measured signal obtained therefrom is then compared with a desired potential value of a control instrument. As long as the redox potential has a sufficiently positive reading, a lead sulfide containing raw material, e.g., an ore or concentrate, can be fed into the leaching vessel 1 by means of a metering device, either continuously or intermittently. Once the redox potential falls below the desired value, the feed of lead sulfide into the leaching vessel can be interrupted.

The illustration of the apparatus to be used for the method is schematically set forth in FIG. 1. For example, the cathode 8 may comprise a large number of electrically conductive particles housed in a cage that is closed at all sides but having perforated walls. Such a cathode has a very large surface area and is therefore very well suited for the deposition of lead. A cathode of this type is disclosed in U.S. Pat. No. 4,123,340, which patent is hereby incorporated by reference. The deposition conditions can be improved even more, if the cage is moved during electrolysis so that the particles are moved continuously as well. Dead spaces and potential-free zones, within the particle bed, are thus avoided. The particles covered with lead can be removed from the cage either at certain time intervals or in a continuous manner and can be replaced by new particles.

Cathode 8 may also comprise a plurality of rods that are arranged in special mounts (holding devices) so that the rods continue to hit one another during rotation or some other movement of the mounts. The lead deposited upon the rods is thereby repeatedly strained and is finally broken away from the rods, in fragmentary pieces, dropping to the bottom of the electrolytic cell from where it can be removed. The use of rods in this manner is disclosed in U.S. Pat. No. 4,144,148, which patent is hereby incorporated by reference.

Figure 3:
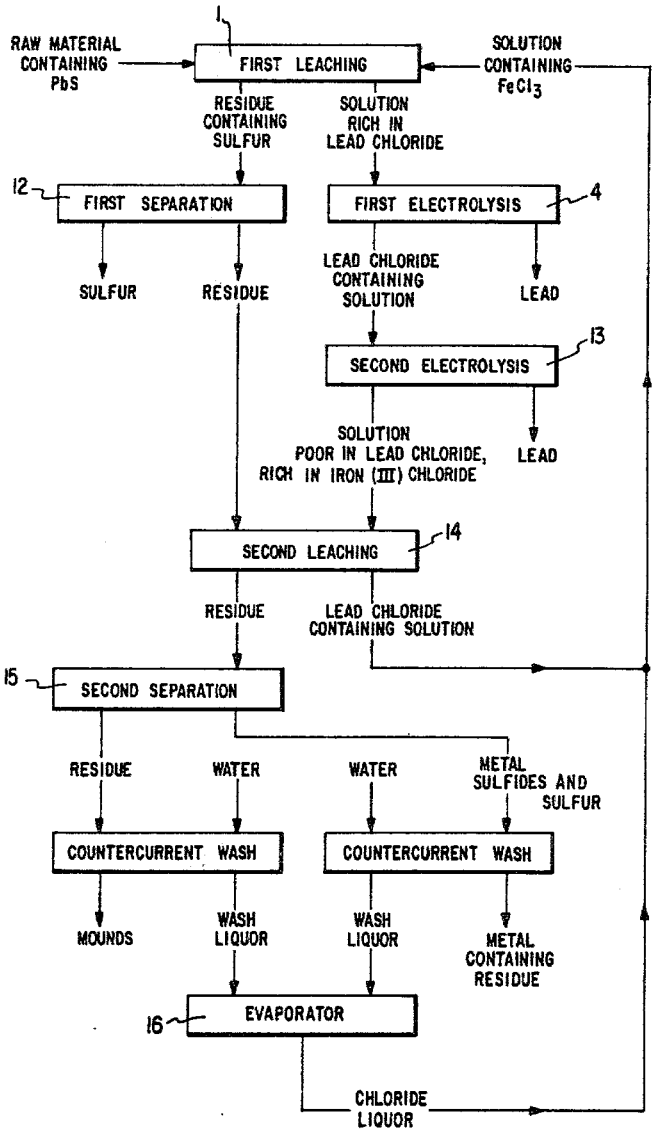

According to a further embodiment of the present invention as set forth in FIG. 3, the lead chloride containing solution 2 can be conducted through a plurality of electrolytic cells, in succession, as illustrated in FIG. 3. The electrolytic cells can be electrically connected either in parallel or in series. By varying the anodic and cathodic current densities in the individual electrolytic cells, it is possible to vary the anodic and cathodic current efficiencies of the entire process and adjust it in accordance with the consistency of the ore.

In accordance with the embodiment illustrated in FIG. 3, lead sulfide containing raw material is subjected to a first leaching in the leaching vessel 1, producing both a sulfur containing residue and a solution rich in lead chloride. The sulfur containing residue is processed in apparatus 12 in a first separation stage in order to separate the elemental sulfur from the residue. According to the state of the art elemental sulfur can be easily separated from the metal sulfides and the gangue by flotation which has proven quite successfully.

The iron (II) chloride solution rich in lead chloride and obtained during the first leaching stage, enters the first electrolytic cell 4. There, part of the lead ions is discharged and iron (III) ions are formed at the anode. In the second electrolytic cell 13, the lead separation and the oxidation of iron (II) ions is continued. The residue obtained from the first separation 12 is now further treated together with the solution from the second electrolytic cell 13 which is poor (low) in lead chloride and rich in iron (III) chloride in a second leaching stage in a leaching vessel 14. The iron (III) chloride and lead chloride containing solution resulting therefrom is returned to the leaching vessel 1 in the first leaching stage.

During the second leaching stage that takes place in vessel 14, a residue is produced which is separated in a second separation stage by ore dressing into a gangue residue (mounds) and a sulfurous product containing elemental sulfur and the sulfides of metal impurities like copper, zinc, silver, arsenic and antimony, usually present in lead sulfide ores and concentrates. The mounds and the sulfide residues containing sulfur are washed separately, in a countercurrent wash in order to wash out the chlorides as completely as possible. The wash liquor, from the countercurrent wash, is condensed in an evaporator 16 to the extent that its volume is just sufficient to equalize the water balance in the hydrometallurgical process and is also charged to the first leaching stage in leaching vessel 1.

The electrolytically deposited lead is molten and refined to high grade lead in a conventional manner. The sulfide containing residue that contains precious metals therewith, and which is obtained after the second separation and the countercurrent wash, is also processed in a conventional manner. The method to be employed for this depends on the composition of the lead sulfide containing raw material used for the recovery of lead because it determines quantity and composition of the sulfide containing residue.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

400 Grams of a sulfide containing raw material (a galena concentrate) containing 77% lead, 0.65% copper, 1.6% zinc, 0.45% antimony, 0.15% arsenic, 1.5% iron and 14% sulfur was initially fed into a leaching vessel and leached in 8 liters of a solution containing 170 grams per liter sodium chloride, 17 grams per liter lead chloride, 17 grams per liter iron (III) chloride, and some hydrochloric acid as to adjust the pH-value of the solution to about 1. The latter solution contained 122 grams per liter chloride ions. The leaching step lasted for about 5 hours. The resulting iron (II) chloride solution containing lead chloride was then treated in an electrolytic cell of the type disclosed in U.S. Pat. No. 4,123,340, comprising a particle electrode mode from copper spheres and two anodes made from graphite. The lead chloride containing brine was delivered from the leaching vessel into the space between the particle cathode of the electroytic cell where lead had been deposited. The spent solution has been sucked off at the anodes and returned to the leaching tank. Between the cathodic particles and the anodes there has been no separating diaphragm or membrane. The temperature in the leaching vessel was about 48° C. and in the electrolytic cell it was about 52° C. The current efficiency for the lead deposition was 95%, and the efficiency for the oxidation of sulfur in the form of a sulfide was about 92%. 1.1 kg lead and 0.21 kg of sulfur were obtained per kilowatt hour.

EXAMPLE 2

2000 Grams of a sulfide containing raw material (an ore concentrate) containing 69% lead, 0.2% copper, 6.9% zinc, 0.05% antimony, 0.02% arsenic, 2.5% iron and 16.5% sulfur, was fed into a leaching vessel and leached in 110 liters of a solution comprising 240 grams per liter sodium chloride, 17 grams per liter lead chloride, 17 grams per liter iron (III) chloride with a pH-value adjusted to about 1.2 by addition of some hydrochloric acid. The latter solution contained 165 grams per liter chloride ions and about 0.1 grams per liter sulfide ions. The leaching step lasted for about 8 hours. The resulting solution had been continuously circulated between the leaching vessel and an electrolytic cell of the type disclosed in U.S. Pat. No. 4,144,148. The cathode rods were made of copper plated steel and the anodes consisted of graphite. The liquor from the leaching tank had been decanted from the leaching vessel and fed onto the cathodic rods. The plated out brine containing reoxidized iron (III) ions had been sucked off behind the anodes and recirculated into the leaching vessel. The current efficiencies obtained for the lead and sulfur depositions were 90% and 89%, respectively, and 0.95 kg lead and 0.195 kg sulfur were obtained per kilowatt hour.

It will be understood that the above description of the present invention is susceptible to various modifications, changes and adaptations, and the same are intended to be comprehended within the meaning and range of equivalents of the appended claims.

We claim:

1. Method for recovery of lead from a lead sulfide containing material comprising:

(a) leaching said material in a leaching vessel containing a chloride solution to which iron (III) chloride is added as an oxidation agent, to produce an iron (II) chloride solution rich in lead chloride;

(b) conducting said iron (II) chloride solution rich in lead chloride to an electrolytic cell not containing a permselective membrane or a diaphragm; said electrolytic cell comprising at least one insoluble anode; at least one cathode for the cathodic deposition of lead; and an electrolyte;

(c) subjecting said iron (II) chloride solution rich in lead chloride to electrolysis in said electrolytic cell to deposit metallic lead cathodically and to obtain an electrolyte comprising iron (III) ions formed by the reoxidation of iron (II) chloride at the anode, while causing said iron (II) chloride solution to move from the cathode to the anode of said cell by sucking off said electrolyte containing iron (III) ions at/or behind said anode; and (d) returning said electrolyte containing said iron (III) ions to said leaching vessel.

2. The method of claim 1 further comprising continuously pumping said iron (II) chloride solution from said leaching vessel into the electrolytic cell and said electrolyte from said electroytic cell to said leaching vessel through separate conduit means connecting said leaching vessel and said electrolytic cell.

3. The method of claim 1 comprising continuously replenishing said leaching vessel with a lead sulfide containing material.

4. The method of claim 2 comprising continuously replenishing said leaching vessel with a lead sulfide containing material.

5. The method of claim 3 comprising automatically introducing said material into said leaching vessel in a continuous or discontinuous manner and in measured quantities depending upon the measured redox potential of said iron chloride containing solution present in said leaching vessel.

6. The method of claim 1 comprising conducting said lead chloride containing solution through a plurality of electrolytic cells, in succession, said electrolytic cells being connected electrically, in series or in parallel.

7. The method of claim 2 comprising conducting said lead chloride containing solution through a plurality of electrolytic cells, in succession, said electrolyte cells being connected electrically, in series or in parallel.

8. The method of claim 5 comprising conducting said lead chloride containing solution through a plurality of electrolytic cells, in succession, said electrolytic cells being connected electrically, in series or in parallel.

9. The method of claim 1 comprising obtaining a chloride containing solution by treating a sulfur containing residue obtained in said leaching step and returning said chloride containing solution to said leaching vessel.

10. The method of claim 1 wherein said cathode comprises a plurality of electrically conductive particles arranged within a cage that is closed all around but whose walls are perforated.

11. The method of claim 10 wherein said cage is moved by external forces during the electrolysis so as to move the particles.

12. The method of claim 1 wherein said cathode comprises a plurality of rods, said rods being arranged in special mounts so that said rods continue to hit one another during rotation or other movement of said mounts, whereupon the lead deposited upon said rods is repeatedly strained and broken away from said rods, in fragmentary pieces.

13. The method of claim 9 wherein said cathode comprises a plurality of rods, said rods being arranged in special mounts so that said rods continue to hit one another during rotation or other movement of said mounts, whereupon the lead deposited upon said rods is repeatedly strained and broken away from said rods, in fragmentary pieces.

14. The method of claim 1 wherein said iron (II) chloride solution is caused to move by conducting said iron (II) chloride solution rich in lead chloride to said electrolytic cell in the area of said cathode.

* * * * *

UNITED STATES PATENT AND TRADEMARK OFFICE

CERTIFICATE OF CORRECTION

PATENT NO. : 4,312,724

DATED : January 26th, 1982

INVENTOR(S) : Roland Kammel et al

It is certified that error appears in the above—identified patent and that said Letters Patent is hereby corrected as shown below:

In the heading of the patent, before [21], insert

--[73] Assignee: GÖTZELMANN KG, Industrieabwasser-Anlagen Stuttgart, Federal Republic of Germany--

Signed and Sealed this

*Fifteenth* Day of *June 1982*

[SEAL]

*Attest:*

GERALD J. MOSSINGHOFF

*Attesting Officer*

*Commissioner of Patents and Trademarks*